US010125487B2

(12) United States Patent
Hochstuhl et al.

(10) Patent No.: US 10,125,487 B2
(45) Date of Patent: Nov. 13, 2018

(54) THERMAL INSULATION ELEMENT

(71) Applicant: Schock Bauteile GmbH, Baden-Baden (DE)

(72) Inventors: Jochen Hochstuhl, Gernsbach (DE); Martin Fenchel, Stutensee (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

(21) Appl. No.: 15/137,488

(22) Filed: Apr. 25, 2016

(65) Prior Publication Data

US 2016/0312459 A1 Oct. 27, 2016

(30) Foreign Application Priority Data

Apr. 23, 2015 (DE) ..... 10 2015 106 296

(51) Int. Cl.

| | |
|---|---|
| ***E04B 1/41*** | (2006.01) |
| ***E04B 1/16*** | (2006.01) |
| ***E04B 1/76*** | (2006.01) |
| ***E04C 5/06*** | (2006.01) |
| ***E04B 1/78*** | (2006.01) |
| *E04C 3/34* | (2006.01) |

(52) U.S. Cl.

CPC ..... *E04B 1/41* (2013.01); *E04B 1/165* (2013.01); *E04B 1/76* (2013.01); *E04B 1/78* (2013.01); *E04C 5/06* (2013.01); *E04B 2001/7679* (2013.01); *E04C 3/34* (2013.01); *E04C 5/0604* (2013.01)

(58) Field of Classification Search

CPC ... E04B 1/165; E04B 1/41; E04B 1/76; E04B 1/78; E04C 5/06

USPC ..... 52/699

See application file for complete search history.

(56) References Cited

U.S. PATENT DOCUMENTS 3,724,145 A * 4/1973 Daniel ..... E02D 5/801 256/32
4,209,560 A * 6/1980 Vasilos ..... C04B 33/32 428/109
4,338,759 A * 7/1982 Swerdlow ..... E04B 2/86 52/742.14

(Continued)

FOREIGN PATENT DOCUMENTS

DE 3105489 11/1982
DE 19823100 1/2000

(Continued)

OTHER PUBLICATIONS

EGCO AG: ALPHADOCK: Der neue Wandnschluss fur thermisch getrennte Wande (The New Wall Connector for Thermally Separating Walls) Bosingen, Switzerland, Apr. 2014.

*Primary Examiner* — Charles A Fox
*Assistant Examiner* — Joseph J. Sadlon
(74) *Attorney, Agent, or Firm* — Volpe and Koenig, P.C.

(57) ABSTRACT

In a thermal insulation element, which is made at least partially from a compression load transferring material and comprises an upper and a lower support area for the vertical connection to the building parts to be constructed from concrete, it is provided that the thermal insulation element comprises at least one penetrating opening extending from the upper to the lower support area which is embodied for passing a compacting device for fresh concrete.

7 Claims, 7 Drawing Sheets

(56) References Cited

U.S. PATENT DOCUMENTS 4,378,032 A * 3/1983 Saggese ..... B28B 21/56 138/103
4,394,201 A * 7/1983 Haeussler ..... B28B 23/028 156/242
4,953,332 A * 9/1990 Galloway ..... E04C 3/34 52/223.5
5,218,809 A * 6/1993 Baumann ..... E04C 5/064 52/426
5,633,057 A * 5/1997 Fawley ..... B29C 53/562 428/36.1
5,867,964 A * 2/1999 Perrin ..... E04B 1/165 52/236.8
7,814,719 B2 * 10/2010 Cretti ..... E04B 5/19 52/319
7,926,235 B2 * 4/2011 Shaw ..... E04B 1/6812 52/396.02
8,375,678 B1 * 2/2013 Ferrer ..... E04C 5/165 52/414
8,381,485 B2 * 2/2013 Platt ..... B28B 7/164 14/74.5
8,555,584 B2 * 10/2013 Ciuperca ..... E04B 1/355 52/309.12
8,590,241 B2 * 11/2013 Koch ..... E04B 1/161 52/394
8,840,336 B2 * 9/2014 Smith ..... E01C 11/02 404/47
8,875,458 B2 * 11/2014 Fritschi ..... E04B 1/003 52/259
9,561,606 B2 * 2/2017 O'Leary ..... B29C 44/185
9,758,967 B2 * 9/2017 Persson ..... E04C 5/01
9,856,639 B2 * 1/2018 Koszo ..... E04B 1/165
2005/0097854 A1 5/2005 Tu
2005/0241263 A1 * 11/2005 Van Rijn ..... E04G 21/185 52/745.21
2010/0024346 A1 * 2/2010 Strahin ..... E04C 5/20 52/699
2011/0258964 A1 * 10/2011 Wu ..... E04B 1/14 52/791.1
2012/0240497 A1 * 9/2012 O'Brien ..... E04B 5/43 52/223.6
2014/0260067 A1 * 9/2014 Pryor ..... F16B 37/0857 52/704
2015/0013255 A1 * 1/2015 Hunt ..... E04B 1/20 52/236.3

FOREIGN PATENT DOCUMENTS

DE 10106222 8/2002
DE 102005001270 9/2005
EP 0745733 12/1996
EP 2405065 1/2012

* cited by examiner

THERMAL INSULATION ELEMENT

INCORPORATION BY REFERENCE

The following documents are incorporated herein by reference as if fully set forth: German Patent Application No. DE 102015106296.8, filed Apr. 23, 2015.

BACKGROUND

The present invention relates to a thermal insulation element for thermally decoupling load-bearing building parts to be made from concrete, preferably between a vertical building part, particularly a support, and a horizontal building part located above or below thereof, particularly a ceiling or a floor.

In above-ground construction, frequently load-bearing building parts are made from reinforced concrete constructions. For energy-saving reasons, such building parts are generally provided with a thermal insulation applied at the outside. In particular the ceiling between the underground level, such as a basement or underground garage, and the ground floor is frequently equipped at the side of the underground level with a thermal insulation applied at said ceiling. Here, the difficulty is given in that the load-bearing building parts, on which the building rests such as supports and exterior walls, must be connected in a load-transferring fashion to the building parts located thereabove, particularly the ceiling. This is generally achieved such that the ceiling is connected in a monolithic fashion with continuous reinforcements to the load-bearing supports and the exterior walls. However, here heat bridges develop which can only be compensated with difficulty by a thermal insulation subsequently applied at the outside. In underground garages, for example frequently the upper sections of the load-bearing concrete supports, pointing towards the ceiling, are also coated with thermal insulation. This is not only expensive but also visually not very appealing, but it also yields to unsatisfactory results with regards to the physics of the construction and furthermore reduces the parking space available in the underground parking garage.

A brick-shaped wall element is described in DE 101 06 222 for thermally decoupling wall parts and floor or ceiling parts. The thermal insulation element has a compression-resistant support structure with insulating elements arranged in the interim spaces. The support structure may be made from light-weight concrete, for example. Such a thermal insulation element serves for the thermal insulation of masonry exterior walls, for example by using it like a conventional brick for the first layer of bricks of the load-bearing exterior wall above the basement ceiling.

A compression load-transferring and insulating connection element is known from EP 2 405 065, which can be used for the vertical, load-transferring connection of building parts to be made from concrete. It comprises an isolating body with one or more compression elements embedded therein. Lateral reinforcement elements extend through the compression elements to building parts to be erected from concrete abutting thereto essentially vertically beyond the top and the bottom of the insulation body. The isolation body can for example be made from cellular glass or expanded rigid polystyrene foam, and the compression elements from concrete, asbestos cement, or fibrous synthetic.

When installing such a prefabricated connection element the reinforcement elements must be embedded in concrete together with the abutting building parts. For this purpose, the connection element must be installed in a closed casing for the building part located underneath thereof and concrete must be cast from the bottom against existing, not accessible and not visible, bottom areas of the connection element. In particular in case of supports and exterior walls representing load-bearing building parts here an inappropriate execution during the construction of the building parts particularly at the connection site to the connection element can later lead to severe static problems for the building. Furthermore, here any control and monitoring of the execution is hardly possible. In particular, an inspection before and during the pouring of concrete is not possible due to the situation of the installation inside the casing. Any review of the finished building part is also hardly possible because the connection site between the building part and the connection element is not accessible.

SUMMARY

The invention is therefore based on the objective to provide a thermal insulation element which allows a reliable installation at a vertically load-transferring connection site between two building parts to be erected from concrete.

The objective is attained with one or more features of the invention. Advantageous embodiments are discernible from the description and claims that follow. Furthermore, the invention relates to a method for installing a respective thermal insulation element.

In a thermal insulation element according to the invention, which at least partially comprises a compression load-transferring material and has an upper and a lower contact area for the vertical connection to the building parts to be erected from concrete, the objective is attained in that the thermal insulation element has at least one penetrating opening extending from the upper to the lower support area, which is embodied for guiding a compacting device through it. The penetrating opening serves therefore as an immersion site for an internal vibrator. Preferably the penetrating opening is arranged approximately in the middle of the thermal insulation element.

The present invention is based on the acknowledgement that during the installation and subsequent embedding in concrete against the bottom of said thermal insulation element insufficient and undefined compacting of the cast-in-place concrete can occur underneath the thermal insulation element, which additionally largely depends on the composition of the concrete used on site. According to the acknowledgement of the invention two processes may lead at the bottom of the thermal insulation element during the setting of the cast-in-place concrete to the load-transferring connection of the thermal insulation element to the underlying building part being insufficient. On the one hand, rising air bubbles, so-called compacting pores, may lead to the formation of cavities at the bottom of the thermal insulation element, and thus lead to a statically insufficient connection. Sedimentation represents an even more critical process in the cast-in-place concrete not yet completely set, in which heavier additives slowly sink and water and/or cement paste separates at the surface of the concrete. After the concrete part has set and dried, in this case large cavities can form between the thermal insulation element and the underlying concrete part, which are not visible from the outside.

In order to avoid this, in the thermal insulation element according to the invention a penetrating opening is provided, through which a compacting device, such as a vibration head of a concrete vibrator, can be guided in order to compact and/or subsequently compact the cast-in-place concrete located underneath the thermal insulation element after installation thereof. By this compacting and/or subsequent compacting the problems described can be avoided and a reliable connection of the thermal insulation element to the building part located underneath thereof can be achieved.

In a particularly preferred embodiment the thermal insulation element is at least partially produced from a compression load transferring and thermally insulating material. This material may preferably represent light-weight concrete. Using light-weight concrete, high-compression resistant form elements can be produced under factory conditions showing low specific thermal conductivity. Depending on static requirements, such a form part made from light-weight concrete, in addition to the penetrating opening according to the invention, may also show additional hollow chambers or enclosed insulating elements.

Light-weight concrete according to present regulations is defined as concrete having an apparent density of maximally 2000 kg/m$^3$. The low density compared to standard concrete is achieved by appropriate production methods and different light-weight grain sizes, preferably grains with a core porosity of expanded clay. Depending on composition, light-weight concrete has a thermal conductivity from 0.2 to 1.6 W/(m·K).

Another advantage results in that in case of identical strength class of the coefficient of elasticity, light-weight concrete only shows approximately 30 to 70% of the values of standard concrete. Accordingly, under identical stress (tension) the elastic deformations are on average 1.5 to 3-times greater. For this reason, the thermal insulation element made from light-weight concrete simultaneously acts as a tension damping element and is capable to compensate the position, minor settlements, and elastic deformations of component parts located thereabove and to ensure a more homogenous distribution and introduction of force of eccentric support forces to and/or into the underlying building part, particularly a support.

The considerably lower coefficient of elasticity of the light-weight concrete used here acts in a particularly beneficial fashion upon load-eccentricity and support distortions, which lead to increased pressure upon edges. Based on its elastic features the thermal insulation element acts like a "centering element". In contrast thereto, the compression under central load is of secondary importance.

The typical coefficient of elasticity of standard concrete, as used for supports, ranges from $E_{cm}$=30,000 to 40,000 N/mm$^2$. The coefficient of elasticity of the light-weight concrete preferred within the scope of the invention ranges therefore from approximately 9,000 to 22,000 N/mm$^2$, preferably from 12,000 to 16,000 N/mm$^2$, it most preferably amounts to approximately 14,000 N/mm$^2$.

Alternatively the thermal insulation element may also comprise a thermally insulating but not compression load transferring insulating body, for example made from extruded polystyrene with one or more compression strength bodies embedded therein. Such compression strength bodies may be made from high-strength concrete, with a reduction of thermal conductivity of the thermal insulation element in this case being achieved by an appropriately small basic area of the compression strength elements. In this case as well it is essential that during installation of the thermal insulation element here post-compression occurs of the underlying building part to be made from concrete by an appropriate vibration tool being inserted via the penetrating opening provided in the thermal insulation element into the underlying cast-in-place concrete of the abutting building part freshly to be made from concrete.

Unlike massive thermal insulation elements or those made from light-weight concrete hollow blocks, the latter-mentioned variant has the disadvantage, due to the considerably smaller support area, that even minor weak spots in the connection to the underlying building part, caused by the formation of cavities or sedimentation, lead to considerably greater compromising effects upon the static stability of the construction. In the worst case scenario, here a local overload may occur and thus a failure of individual compression strength elements of the thermal insulation element. This risk is considerably lower in a compression load transferring material, such as light-weight concrete, due to the considerably greater support area of the thermal insulation element.

Another advantage of the present invention develops when the lower support area of the thermal insulation element has a surface with a three-dimensional profile. By an appropriate profiling of the surface the defects in the connection between the thermal insulation element and the underlying freshly prepared concrete building part can be further reduced. For example, the surface may include projections and recesses as well as inclined areas, grooves, or the like so that in case of sedimentation developing the precipitating surface water can drain into non-critical areas and/or precipitate there, while in areas of the thermal insulation element critical for the static connection a close connection develops to the freshly created concrete of the underlying building part.

In this context, one embodiment is considered particularly preferred in which the lower support area shows a funnel-shaped surface declined or arched in the direction of the penetrating opening. This way it is achieved that in case of sedimentation developing the precipitating surface water is moved in the direction of the penetrating opening and/or towards the outside and thus precipitates in areas of lower significance with regards to static strength.

In one preferred embodiment of the present invention, additionally one or more rod-shaped reinforcement elements are provided, which penetrate the thermal insulation element and extend essentially beyond the upper and lower support area. With such reinforcement elements the thermal insulation element can be connected to adjacent building parts and perhaps be connected to its reinforcement. This way a monolithic connection of the building parts is yielded, even when based on the static conditions the connection is only considered a concrete link and the reinforcement elements therefore fulfill a rather constructive function without major importance for the static of the building.

Preferably the reinforcement elements may be embodied as reinforcing rods, which primarily serve to transfer tensile forces. Frequently reinforcing elements which need to cross thermal insulation elements must be made from stainless steel and/or non-corrosive steel for reasons of structural physics. Within the scope of the present invention, for reasons of better thermal insulation, the reinforcement elements may preferably be produced from a fibrous composite, such as fiberglass reinforced synthetic.

Furthermore, it has proven advantageous to arrange a reinforcing bar inside the compression load-transferring thermal insulation element. Such a reinforcing bar in the form of a closed reinforcing ring, showing for example a circular or polygonal cross-section with rounded edges, which is arranged in reference to the support areas essentially in a parallel level, can further increase the compression resistance of the thermal insulation element by minimizing the lateral extension of the thermal insulation element under compression.

Another advantageous aspect of the present invention results when at least one seal is provided at the thermal insulation element around its vertical boundary areas, which ensures a tight installation of the thermal insulation element in a casing for the building part located underneath thereof. On the one hand, by such a seal it is prevented that upon insertion of the thermal insulation element or concrete formation of the underlying building part fresh concrete can penetrate between the casing and the thermal insulation element and rise here. On the other hand, such a seal prevents the penetration of air between the casing and thermal insulation element if after the compacting has occurred, the vibration device is pulled of the thermal insulation element through of the penetrating opening and the thermal insulation element drops by the volume previously displaced by the vibration device inside the casing of the underlying building part.

In addition to the penetrating opening for the vibration tool, additional casting openings may be provided in the thermal insulation element via which any additional casting material required after the concrete has cured, such as casting mortar, can be injected in to fill out any potentially remaining cavities between the underlying building part and the thermal insulation element. Preferably the respective casting openings are closed via removable plugs so that they cannot be clogged by cast-in-place concrete during the installation of the thermal installation element.

Furthermore, within the scope of the present invention it is preferred that a closing plug is provided by which the penetrating opening can subsequently be closed. Here, it is further preferred that the closing plug is made from a thermally insulating but non-load bearing material, such as extruded polystyrene. Additionally, such a closing plug can be shaped conically such that it can be inserted in a sealing fashion into the penetrating opening, preferably also conically tapering towards the bottom. This way it is ensured that after the installation of the thermally insulating element no heat bridge remains through said penetrating opening, for example based on cast-in-place concrete seeping into the penetrating opening during the formation of the concrete ceiling located thereunder.

Additionally, in the thermal insulating element one or more indicators may be provided, which indicate sufficient contact of the lower contact area with the fresh concrete of the building part to be constructed underneath. Such indicators may for example be embodied like a floater. When in case of sufficient contact the indicator becomes visible at the upper contact area of the thermal insulation element it is ensured that sufficient contact is given to the underlying concrete area.

In order to allow passing a vibration tool, for example the vibrating head of a concrete vibrator, the penetrating opening comprises an opening size, which is sufficient to allow passing vibration heads common on construction sites through it, particularly showing at least 50 mm, preferably ranging from 60 to 80 mm.

The invention further relates to a method for the installation of such a thermal insulation element between two load-bearing building parts to be erected from concrete, preferably between a vertical building part, particularly a support, and a horizontal building part to be arranged above or below it, particularly a ceiling or a floor. Here, initially a casing is prepared for the lower building part and the lower building part is formed from concrete by cast-in-place concrete being filled into the casing and compacted. Then in a second step the thermal insulating element is inserted into the casing for the lower building part. Here, any potential reinforcing elements projecting downwards beyond the thermal insulating element are pressed into the fresh cast-in-place concrete of the lower building part. According to the invention, in a subsequent step a post-compression of the concrete occurs with a compression device, which is guided through the penetrating opening in the thermal insulation element. Preferably the penetrating opening can then be closed via a closing plug. Then the upper building part, for example a ceiling, can be erected above the thermal insulation element in a common fashion.

By the subsequent compression of the still fresh cast-in-place concrete of the lower building part after the insertion of the thermal insulation element it is ensured that close contact is given to its lower contact area and cavities caused by the formation of bubbles and sedimentation are avoided between the thermal insulation element and the building part located underneath.

In an alternative installation method the thermal insulation element can also be installed prior to filling the casing with cast-in-place concrete. In this case, the penetrating opening is initially used as the inlet opening for the cast-in-place concrete. Subsequently a compacting of the filled-in cast-in-place concrete occurs by the vibration tool being inserted into the fresh cast-in-place concrete via the penetrating opening.

BRIEF DESCRIPTION OF THE DRAWINGS

Additional features, advantages, and characteristics of the present invention are explained in the following based on the figures and based on exemplary embodiments. Shown here are.

DETAILED DESCRIPTION OF THE PREFERRED EMBODIMENTS

Figure 1:
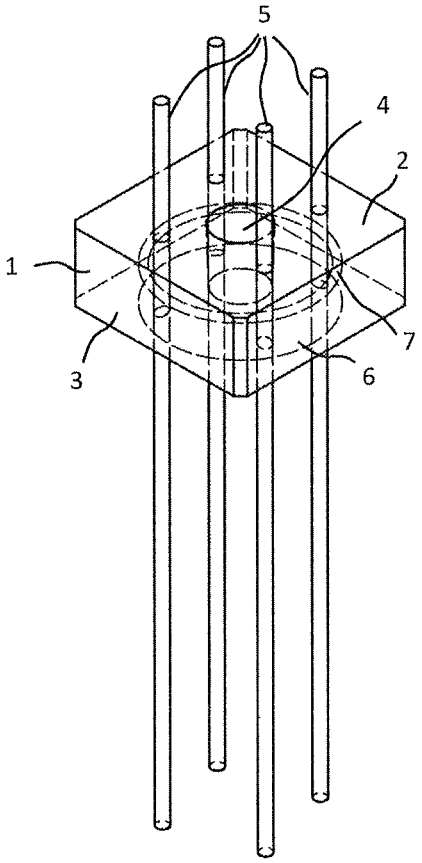
FIG. 1 an isometric view of a thermal insulation element according to the invention made from a compression load-transferring material, particularly light-weight concrete, FIG. 2 a top view of the thermal insulation element of FIG. 1, FIG. 3 a vertical cross-section through the thermal insulation element along the sectional line C-C of FIG. 2, FIG. 4 a further development of the thermal insulation element of FIG. 1 in a side view, FIG. 5 a cross-section of a support of a building equipped with a thermal insulation element, FIG. 6 a cross-section through the support of FIG. 5 and the building parts located above and below thereof along the sectional line B-B, FIG. 7 the reinforcement of the support of FIG. 6 with the thermal insulation element prior to forming the support from concrete, FIG. 8 the support provided with a casing after concrete was filled in, FIG. 9 an enlarged detail of FIG. 8, FIG. 10 an alternative exemplary embodiment with a thermal insulation element arranged in the base section of a support, and FIG. 11 a second exemplary embodiment of a thermal insulation element made from a non-load bearing insulation material with individual compression load bearing bodies inserted therein.
Figure 3:
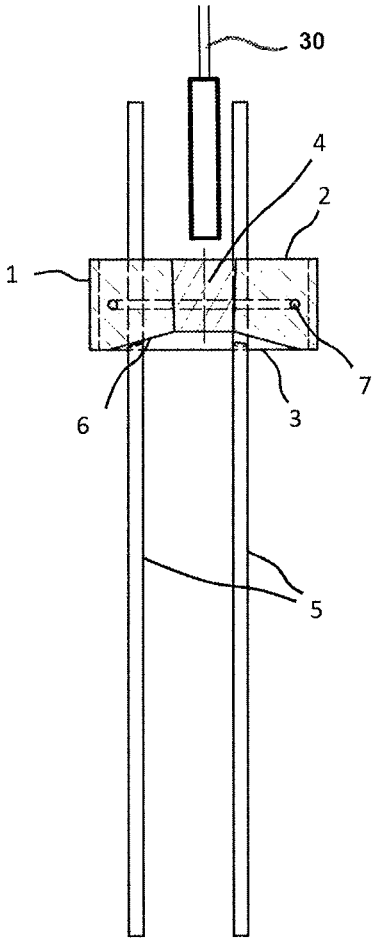
Figure 2:
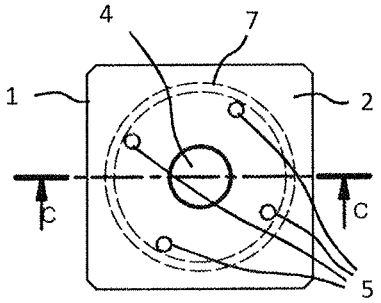

The thermal insulation element 1 shown in FIGS. 1 to 3 serves for the monolithic connection and for the load-transferring connection of a support made from concrete in the underground floor of a building to the ceiling of the basement located thereabove. It shows a cuboid base element 1 with a top 2 and a bottom 3, each of which serving as the support area of the basement ceiling and/or the end of the support carrying it. A central penetrating opening 4 is located in the center of the cuboid thermal insulation element 1, which extends from the top 2 to the bottom 3 of the thermal insulation element 1. Four reinforcing rods 5 extend through the thermal insulation element. The bottom 3 of the thermal insulation element 1 has a three-dimensional profiling in the form of a recess 6 extending like a funnel in the direction of the penetrating openings 4. Inside the thermal insulation element 1 additionally another reinforcing means is embedded perpendicular in reference thereto, for example a reinforcing bar 7, which is arranged about the reinforcing rods 5 and provides additional stability to the thermal insulating element.

The thermal insulation element 1 is made from light-weight concrete, which on the one side has high compression load stability and on the other side has good thermal insulating features. Compared to concrete with a thermal conductivity of approx. 1.6 W/(m·K), when using suitable light-weight concrete the thermal conductivity amounts to approx. 0.5 W/(m·K), which is equivalent to an improvement by approx. 70%. The light-weight concrete used essentially comprises expanded clay, fine sand, preferably light-weight sand, flux agents, as well as stabilizers, preventing any separating or floating of the grain and improving the processing features.

The compressive strength of the thermal insulation element is here sufficiently high to allow the statically planned utilization of the underlying support made from cast-in-place concrete, for example according to the compressive strength classification C25/30. Preferably the compressive strength of the thermal insulation element is at least equivalent to 1.5 times the value required by statics. This achieves that even in case of potential faulty sections at the connection area of the thermal insulation element to the support, here safety reserves are given so that the thermal insulation element remains statically stable even in case of punctually higher stress.

The reinforcement rods 5 crossing the basic body of the thermal insulation element 1 in the vertical direction serve primarily as tensile rods for transferring potentially arising tensile forces. The reinforcing rods 5 may be encased in concrete during the production of the thermal insulation element in the light-weight concrete of the cuboid basic body 1. Alternatively, it is possible for an easier production of the thermal insulation element during the production to install sheaths as a type of dead casing, through which the reinforcement rods 5 are inserted after the curing of the light-weight concrete element 1.

In the exemplary embodiment, the reinforcement rods 5 themselves are made from a fibrous composite, such as the proven reinforcement rod ComBAR® of Schöck, which comprises fiberglass aligned in the direction of force or a synthetic resin matrix. Such a fiberglass reinforcement rod shows an extremely low thermal conductivity, which is up to 100 times lower than the one of concrete steel, and thus it is ideally suitable for the application in the thermal insulation element. Alternatively, reinforcement rods of conventional types comprising stainless steel or construction steel may be used as well, though.

Primarily when using reinforcement rods made from fiber composites the above-described use of sheaths as dead casings is advantageous for the subsequent insertion of reinforcement rods. Reinforcement rods made from fiber composites may transfer very strong tensile forces, however even much lower compression loads can already lead to the destruction of the reinforcement rods. By using sheaths, here a form-fitting embedding of the reinforcement rods in the surrounding concrete is avoided, which normally in case of concrete reinforcements is intended and almost unavoidable. If now a compression load is applied, for example by the building settling, the reinforcement rods can elastically deform inside their sheaths until the compression loads are completely transferred by the compression load stable insulation body 1 such that any damaging compression loads applied upon the reinforcement rods are avoided.

The reinforcement in the thermal insulation element is only designed as tensile reinforcement because the connection between the support and the building ceiling located thereabove can anyway be considered a joint connection with regards to statics. This way, by the use of sheaths for the connection-free penetration of a fiber composite reinforcement, here a connection is yielded between the support and the building ceiling in case of a continuous reinforcement meeting the static requirements of a stable and lasting and/or monolithic connection.

The use of sheaths as dead casings for the subsequent installation of reinforcement rods shows additional considerable advantages for the production. When producing under factory conditions, it is easier to insert sheaths in a casing for the thermal insulation element than the reinforcement rods, which shall penetrate the thermal insulation element at both sides and which must be sealed in reference to the casing. The support is also considerably facilitated when prefabricated thermal insulation elements are embodied without any cumbersome reinforcement rods and the latter are inserted only at the construction site when installing the thermal insulation element in the sheaths of the thermal insulation element.

Without limiting the invention thereto, the dimensions of the reinforcement rods 5 amount in the exemplary embodiment to a diameter of 16 mm with a length of 930 mm. The arrangement of the reinforcement rods 5 in reference to the base area of the basic body 1 is selected slightly outside the primary diagonal. The reason for this is given here in that in a support, in which the reinforcement rods 5 of the thermal insulation element 1 are installed, the reinforcement of the support is already located in the corners.

The reinforcement rod 7 comprises a stainless steel bent to form a ring which is welded to the connection site. The reinforcement rod 7 shows a diameter of approx. 200 mm with a material thickness of 8 mm or 10 mm.

In the exemplary embodiment the basic body of the thermal insulation element 1 has a length of 250×250 mm at the edges. The height amounts to 100 mm and thus it is equivalent to the common thickness of a subsequently applied thermal insulation layer. As discernible primarily in FIG. 3, the penetrating opening extends in a slightly conical fashion, with here the penetrating opening 4 having an opening size diameter of at least 50 mm, and preferably tapering from an upper dimension of 70 mm to a lower dimension of 65 mm. The penetrating opening can also be easily closed via an appropriate, also slightly conical plug (not shown).

Figure 4:
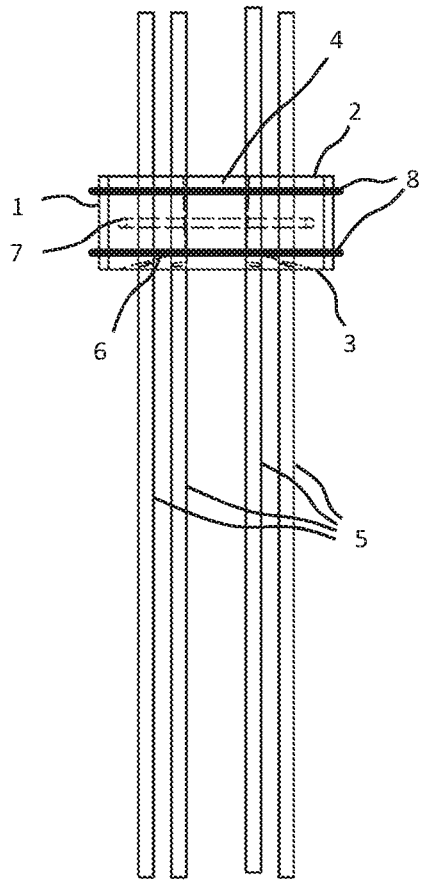

FIG. 4 shows the thermal insulation element in a side view, with additional circumferential seals 8 being applied at the basic body 1. The seals 8 may be embodied as rubber lips or conventional sealing tape, for example. They serve to seal the basic body of the thermal insulation element 1 with tight edges towards a casing for the support to be constructed underneath thereof, in order to prevent any rising of concrete or the penetration of air.

Figure 5:
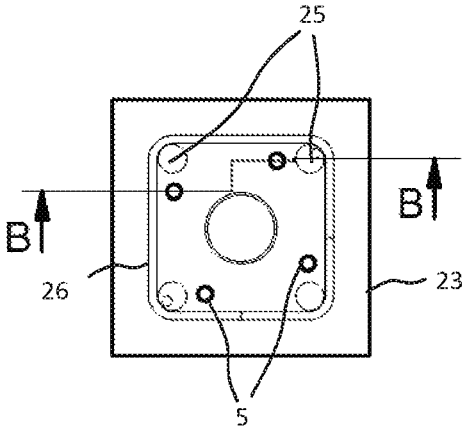

FIG. 5 shows an installation situation of the thermal insulation element in reference to a support 23. The cross-section shown here extends underneath the basic body of the thermal insulation element 1. The support 23 made from cast-in-place concrete shows reinforcements with four vertical reinforcing rods 25 arranged in the corners of the support 23 and a plurality of reinforcement bars 26 arranged horizontally about the reinforcement rods 25 extending in approximately square embodied reinforcement bars 26. The reinforcing rods 5 of the thermal insulation element are each located slightly offset next to the reinforcing rods 25 of the support 23. The sectional line B-B indicated in FIG. 5 is equivalent to the progression of the line of the longitudinal cross-section through the support reinforcement shown in FIG. 7.

Figure 6:
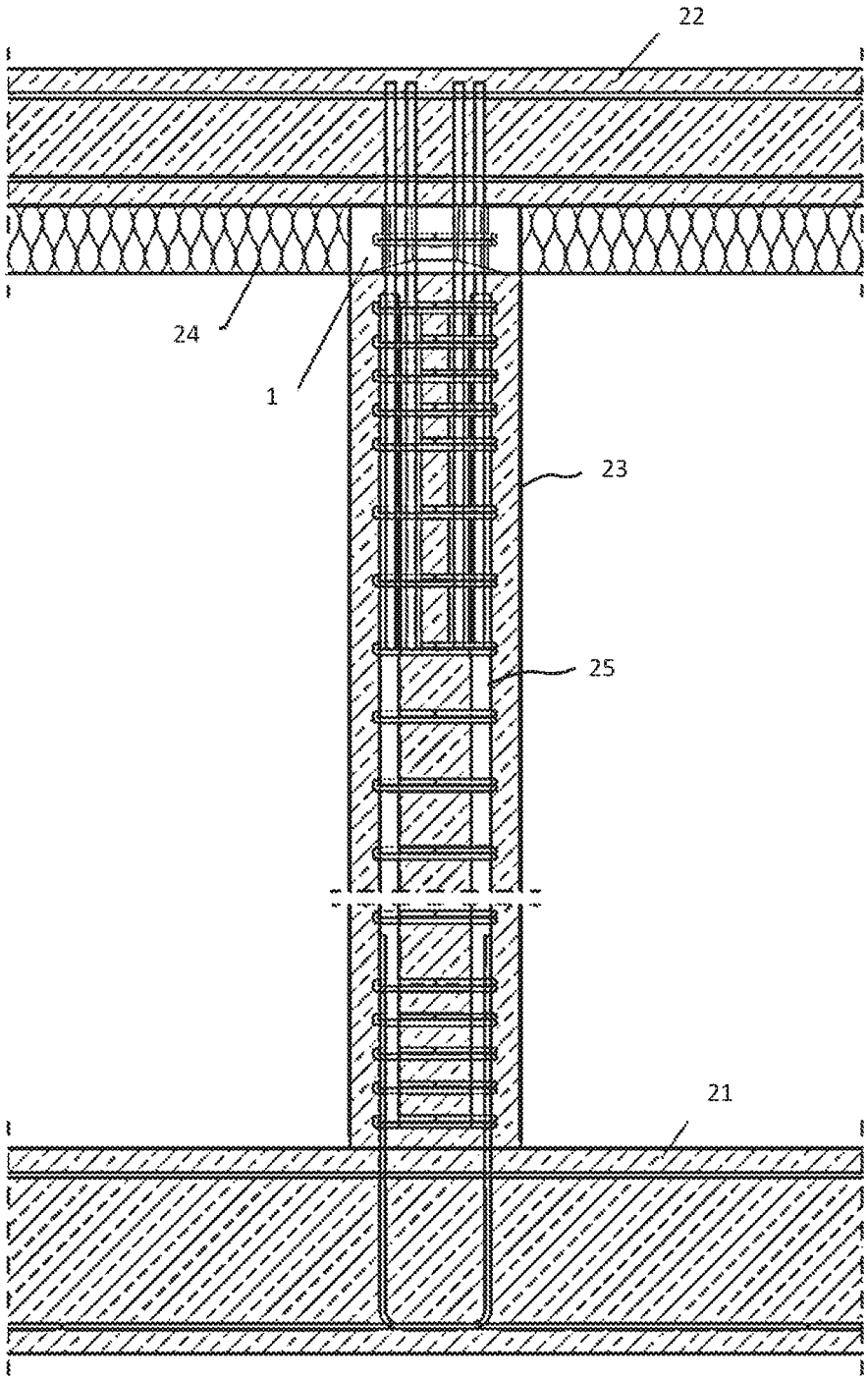

FIG. 6 is shown initially as a longitudinal cross-section through the support 23 and the connected building parts. The support 23 is placed upon a bottom plate 21 and carries a ceiling 22 arranged thereabove. This may represent for example the ceiling of the basement or the underground level of a building. The bottom plate 21, the support 23, and the ceiling 22 are connected to each other in a static fashion. The compression load transferring thermal insulation element 1 is arranged between the support 23 and the ceiling 22, with its reinforcement rods 5 being monolithically cast in the support 23 as well as in the ceiling 22 located thereabove. At the bottom of the ceiling 22, a thermal insulation layer 24 is applied with its strength essentially being equivalent at least to the height of the basic body of the thermal insulation element 1. The thermal insulation layer 24 comprises a highly insulating material, such as mineral insulation plates or cellulose multilayer composites.

Figure 7:
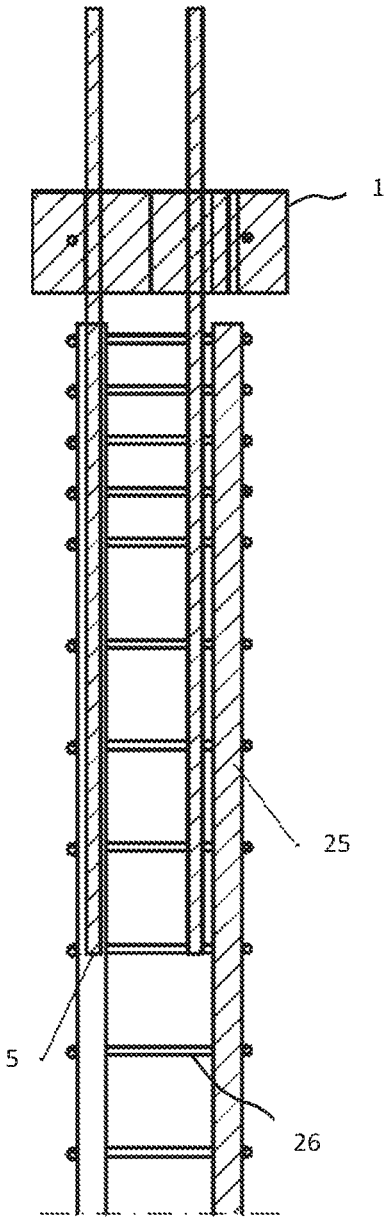

FIG. 7 shows the reinforcement of the support 23 together with the thermal insulation element 1 in a longitudinal cross-section. The progression of the section is here equivalent to the sectional line B-B of FIG. 5. The reinforcement of the support 23 comprises four vertical reinforcement rods 25 arranged in the corners of the support, which for example may be embodied from construction steel with the rods showing a diameter of 28 mm at a length of 2000 mm, as well as a plurality of reinforcement bars arranged circumferential about the reinforcement rods 25 showing an approximately square base. The thermal insulation element 1 is located above the reinforcement of the support, with its reinforcement rods 5 projecting downwards into the support reinforcement.

The reinforcement content of the support 23 amounts to approximately 3-4%. At a typical thermal conductivity value of construction steel of approx. 50 W/(m·K) in reference to concrete with 1.6 W/(m·K) it contributes approximately to half the total thermal conductivity of the support. By the use of the combination of light-weight concrete and fiberglass reinforcement in the area of the thermal insulation element 1 the thermal conductivity between the support 23 and the ceiling 22 can therefore be reduced by approx. 90% in reference to a direct monolithic connection.

Figure 8:
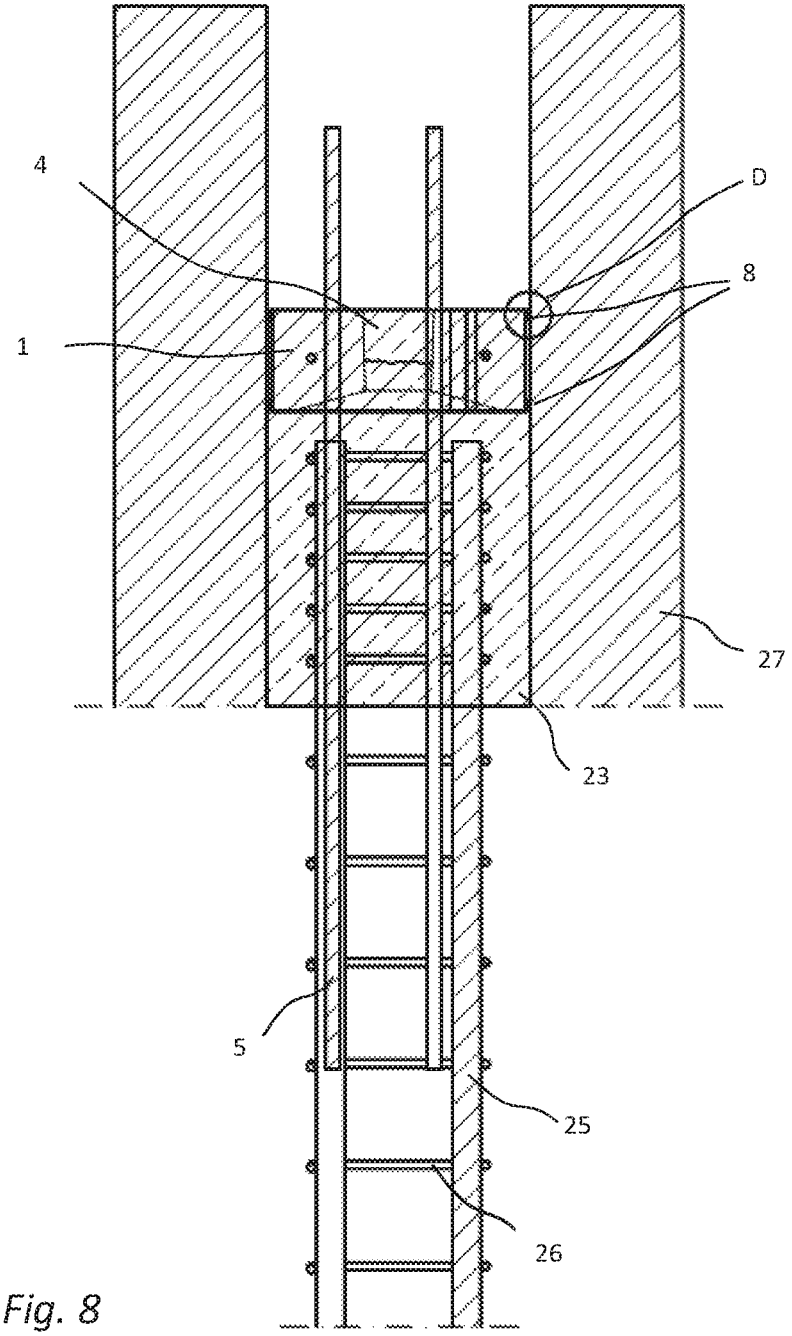
Figure 9:
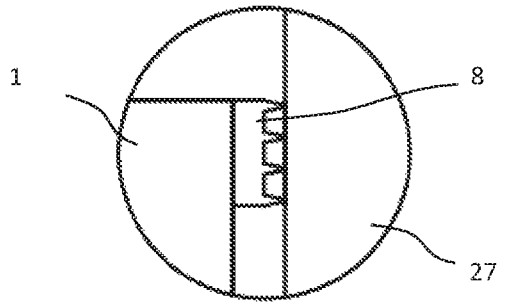

In order to prepare the support 23, as shown in FIG. 8 in the upper half, a casing 27 is installed about the support reinforcement 25, 26 and filled with cast-in-place concrete. It is compacted in a conventional fashion with an internal vibrator. Subsequently the thermal insulation element 1 is inserted into the casing 27 from above and its reinforcement rods 5 are pressed into the still liquid cast-in-place concrete. The basic body 1 is compressed to the fresh cast-in-place concrete until the liquid concrete slightly rises upwards in the penetrating opening 4 such that it is ensured that no more air gap is given between the concrete of the support 23 and the thermal insulation element 1. Subsequently the vibration head of a concrete vibrator is inserted through the penetrating opening 4 into the fresh cast-in-place concrete located underneath in order to compact it once more. When inserting the vibration head the thermal insulation element can be slightly raised by the volume of the concrete displaced by the vibration head. When pulling out the vibration head it must therefore be ensured that the thermal insulation element 1 lowers again by said volume by the thermal insulation element 1 being pushed down accordingly when pulling out the vibrator. Here, the circumferential seal 8 prevents that air can penetrate between the casing 27 and the thermal insulation element 1 or the thermal insulation element 1 can tilt inside the casing 27. FIG. 9 displays the section marked detail D around one of the seals 8 once more in an enlarged fashion.

The subsequent compacting of the still liquid fresh concrete via the penetrating opening of the thermal insulation element 1 leads to a close connection of the thermal insulation element 1 with the cast-in-place concrete located underneath. In particular, elevations due to the formation of bubbles or sedimentation in the fresh concrete are prevented between the thermal insulation element 1 and the support. This is promoted primarily also by the conically extending profiling at the bottom of the basic body 1, based on which the rising air bubbles and/or the surface of the separated cement water can collect primarily in the central area of the penetrating opening 4.

After the support was formed from concrete and the subsequent compacting via the penetrating opening 4 any remnants of concrete remaining in the penetrating opening 4 are removed. Subsequently the penetrating opening 4 is closed via a conical plug (not shown). The closing plug may comprise an insulating material, such as polystyrene or the like, and serves to prevent the penetration of cast-in-place concrete into the penetration opening 4 when subsequently the ceiling 22 is produced. This way potential heat bridges are avoided due to a concrete filling in the penetrating opening 4. Subsequently, above the thermal insulation element 1 the ceiling 22 located thereabove is produced in a common fashion.

Except for the purpose of compacting and/or subsequent compacting the penetrating opening 4 can also be used as an inlet for filling the casing for the support 23 with cast-in-place concrete. In this case, the thermal insulation element is inserted into the still empty casing of the support 23 and perhaps the reinforcement rods 5 are connected to the support reinforcement. Subsequently fresh concrete is filled via the penetrating opening 4 of the thermal insulation element into the casing and then compacted by a vibration head of an internal vibrator being inserted through the penetrating opening 4, as illustrated schematically by the compacting device 30 shown in FIG. 3. Here, too the compacting of fresh concrete against the bottom of the thermal insulation element occurs from the top through the penetrating opening 4. Alternatively the support 23 can also be prepared from self-compacting concrete or the compacting of the support can occur by an external vibrator, of course. Therefore In the latter two cases the penetrating opening 4 serves only as an inlet opening.

Figure 10:
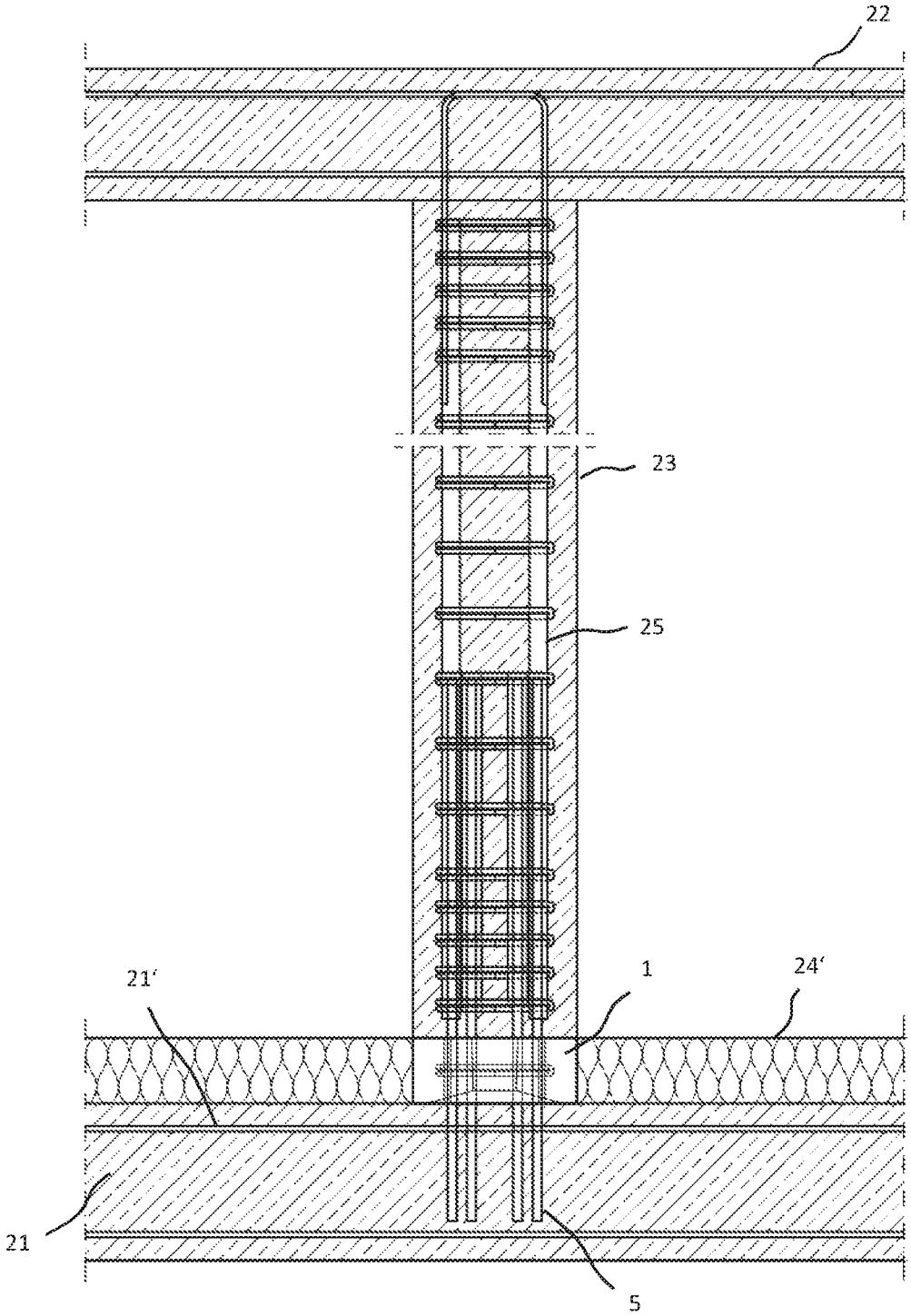

In addition to the installation in the upper area of a support, an installation in the base of a support is possible as well. Such an arrangement is shown in FIG. 10 in an alternative exemplary embodiment. The support 23 is here arranged between the bottom plate 21 and the upper ceiling 22. In the base area of the support 23 a thermal insulation element 1 according to the invention is installed, with its reinforcement rods 5 projecting from the base plate 21 to the upper area of the support 1, and here being connected to the reinforcement 25 of the support 1. A thermal insulation layer 24' made from insulation plates of prior art is applied in this case on the top of the bottom plate 21.

The production can occur such that the thermal insulation element 1 is connected to its reinforcement 21' before the base plate 21 is cast from concrete. The base plate 21 is then cast from cast-in-place concrete such that the concrete rises from the bottom towards the thermal insulation element 1. In order to yield a good connection free from clear space the cast-in-place concrete can in turn be compacted with a vibration tool passed through the central penetrating opening 4. After curing the reinforcement 25 of the support is produced and connected to the reinforcement rods 5 of the thermal insulation element. Subsequently the casing 27 for the support 23 is constructed around the thermal insulation element 1 and then the support 23 is cast and compacted from cast-in-place concrete in a conventional fashion.

Figure 11:
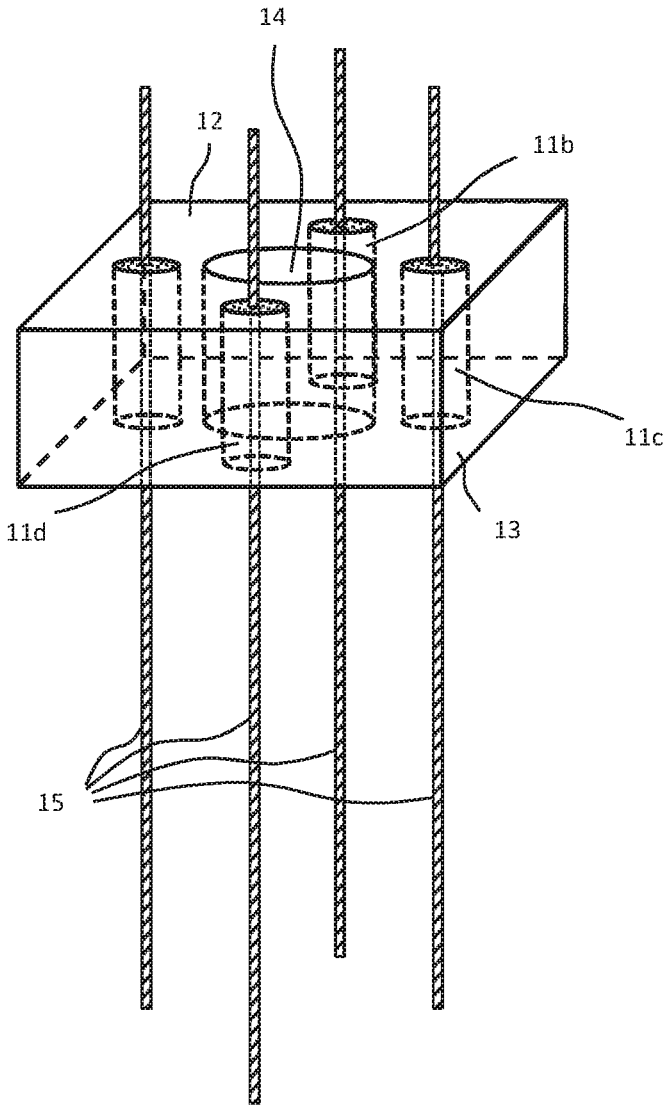

FIG. 11 shows another exemplary embodiment of a thermal insulation element. Unlike the previous exemplary embodiment, here the basic body 10 of the thermal insulation element is not made from light-weight concrete but from a thermal insulation material not transferring any compression loads, such as cellular glass or rigid foamed polystyrene. For compression load transfer here a total of four individual compression load bearing bodies 11*a* to 11*d* are used, which are inserted in the insulating body 10.

The individual compression load bearing elements 11*a* to 11*d* are made from a high-strength concrete in order to allow transferring the load from the building part 22 located thereabove. Reinforcement rods 15 are cast inside the individual compression load bearing elements 11*a* to 11*d* and project in the vertical direction beyond the top 12 and the bottom 13 of the thermal insulation element 15.

Approximately in the center, similar to the previous exemplary embodiment, a penetrating opening 14 is provided which serves as an inlet and/or compacting opening.

The installation of the thermal insulation element 10 occurs like in the previous exemplary embodiment. In this exemplary embodiment the thermal insulation feature is primarily yielded by the reduction of the area of heat bridges to the few individual compression load bearing elements 11*a* to 11*d*. The present invention is here not limited to the shape and number of individual compression load bearing elements shown in the exemplary embodiment. Rather, the portion of compression load-transferring material provided inside the insulating body 10 can be embodied in many other geometries, such as in the form of a compression load transferring cylindrical ring. It is not necessary either to guide the reinforcement rods 15 through the compression load transferring areas 11*a* to 11*d* in the insulation body 10, but they may be placed separated therefrom through areas of the thermal insulation element 10 that are not compression load transferring.

The thermal insulation element itself may be adjusted in its dimensions to the construction part located underneath and/or above. In particular, thermal insulation elements may be adjusted to the typical cross-sections of supports with round, square, or rectangular cross-sections. Typical dimensions of round supports are diameters of 24 and 30 cm, and/or supports with rectangular cross-sections of 25×25 cm and 30×30 cm. Thermal insulation elements with such a geometry may also be combined arbitrarily to form greater supports or load-bearing walls.

The thermal insulation elements described here are particularly suited for the use in connecting links, such as wall supports with low fixing moments. Additionally, the use of load-bearing exterior walls is also possible by installing thermal insulation elements at a suitable distance from each other and any perhaps remaining gaps between the individual thermal insulation elements can be filled with insulation material that is not load bearing.

The geometric design of the profiled bottom of the thermal insulation element may also be realized in many other ways, in addition to the conical shape shown here, for example a stepped form, a radial gearing, an annular bead, and so forth.

In addition to optimizing the geometry of the bottom of the thermal insulation element more and/or alternatively smaller openings may be provided for subsequently casting potentially remaining cavities between the thermal insulation element and the concrete area located underneath. Such openings may be closed with plugs and opened when needed in order to subsequently fill any potentially remaining cavities via a casting mass, such as casting mortar or a synthetic resin, and thus to generate a secure static connection, although in the individual case a faulty embodiment during the preparation of the support and/or the installation of the thermal insulation element had resulted in a flawed connection. Additionally, indicators may be provided at the thermal insulation element which can be pressed upwards like a float and here indicate that the thermal insulation element with its bottom is in contact with the cast-in-place concrete located underneath thereof.

During the installation of the thermal insulation element into already compacted, fresh concrete of the support located underneath, during the subsequent re-compacting, and when the compacting tool being pulled out of the penetrating opening of the thermal insulation element it may be advantageous if a defined compression is applied upon the thermal insulation element.

In addition to the reinforcement rods, within the scope of the present invention other rod-shaped reinforcing means may be used for connecting the thermal insulation elements to the building parts located above and below, for example threaded rods, dowels, and the like, because as explained above the connection between a support and a ceiling located thereabove can be considered a link with regards to statics and the reinforcement at this point must therefore fulfill a constructive function.

The invention claimed is:

1. A method for installing a thermal insulation element (1) for thermal decoupling of load-bearing building parts (23, 22) to be constructed from concrete, between a vertical building part and a horizontal building part located thereabove or below, with the thermal insulation element (1) being made at least partially from a compression load transferring material and comprising an upper and a lower support area (2, 3) for the vertical connection to the building parts (23, 22, 21) and with the thermal insulation element (1) comprising at least one penetrating opening (4) extending from the upper to the lower support area, comprising the following steps:

filling concrete into a casing for the lower building part (23) and compacting the concrete, inserting the thermal insulation element (1) into the casing for the lower building part (23), and subsequently compacting the concrete via a compacting device for fresh concrete, which is inserted via the penetrating opening (4), wherein the penetrating opening is open for receiving the compacting device prior to compaction and finishing.

2. The method of claim 1, further comprising:

sealing the penetrating opening (4) via a closing plug.

3. The method of claim 1, wherein a body of the thermal insulation element (1) is made at least partially from light-weight concrete.

4. The method of claim 1, wherein the thermal insulation element (1) comprises a body with one or more rod-shaped reinforcement elements (5) penetrating through the body and extending essentially vertically beyond the upper and the lower support area (2, 3) and the method further comprises connecting the reinforcement elements (5) to a reinforcement of said vertical building part or to said horizontal building part before casting of said vertical building part or said horizontal building part.

5. The method of claim 1, wherein the thermal insulation element comprises a body formed from the compression load transferring material, and sheaths are embedded in the body and the method comprises inserting rod-shaped reinforcement elements (5) in said sheaths.

6. The method of claim 1, further comprising installing the thermal insulation element (1) in the casing (27) for the building part (23) located underneath thereof and sealing said thermal insulation element against said casing (27) using a seal (8) surrounding vertical boundary areas of said thermal insulation element.

7. The method of claim 1, wherein the thermal insulation element comprises a body having one or more additional casting openings that have a smaller opening size than the penetrating opening (4), and the method further comprises closing said additional casting openings with removable plugs.

* * * * *